United States Patent [19]

Grennard

[11] 4,224,800

[45] Sep. 30, 1980

[54] PROCESS FOR SAFE UNDERGROUND STORAGE OF MATERIALS AND APPARATUS FOR STORAGE OF SUCH MATERIALS

[76] Inventor: Alf H. Grennard, Bergstrasse 21, 6101 Nieder-Ramstadt, Fed. Rep. of Germany

[21] Appl. No.: 954,293

[22] Filed: Oct. 20, 1978

Related U.S. Application Data

[63] Continuation-in-part of Ser. No. 675,210, Apr. 8, 1976, Pat. No. 4,121,429.

[30] Foreign Application Priority Data

Oct. 24, 1977 [CH] Switzerland ..... 013108/77
Feb. 7, 1978 [SE] Sweden ..... 7801413

[51] Int. Cl.[2] ..... F17C 7/02

[52] U.S. Cl. ..... 62/45; 62/260; 73/40.7; 165/45; 405/54

[58] Field of Search ..... 62/45, 260; 73/40.7; 165/45; 405/54

[56] References Cited

U.S. PATENT DOCUMENTS

| | | | |
|---|---|---|---|
| 3,152,640 | 10/1964 | Marx | 405/56 |
| 3,196,622 | 7/1965 | Smith et al. | 405/56 |
| 3,274,785 | 9/1966 | Lange | 405/56 |
| 3,300,982 | 1/1967 | Meade | 62/45 |
| 3,364,729 | 1/1968 | Yearwood | 73/40.7 |
| 3,489,311 | 1/1970 | Folkerts et al. | 73/40.7 |
| 3,581,513 | 6/1976 | Cranmer | 405/56 |
| 3,950,958 | 4/1976 | Loofbourow | 405/56 |
| 3,952,531 | 4/1976 | Turner | 62/45 |

*Primary Examiner*—Ronald C. Capossela
*Attorney, Agent, or Firm*—Haseltine, Lake & Waters

[57] ABSTRACT

A method for the formation of a safe storage area to hold materials, where the storage area is in the form of an underground storage cavern in a preferably rock formation maintained at a different temperature from the natural temperature of the environs surrounding the walls, floor, and the ceiling of said storage cavern. The inside of the storage cavern is with or without insulation and an inner first circulation system surrounds the cavern. The circulation system has a plurality of channels regularly distributed around the cavern and near its surface parallel to the axis of the storage space. The system of tunnels formed of the channels together encloses and surrounds the cavern. Further away from the cavern and on the outside of and in working relation to the first inner circulation system is a second outer circulation system, consisting of a plurality of regularly distributed channels formed either from the said inner tunnel system or between a second outer system of surrounding tunnels parallel to the axis of the storage space and together with said last mentioned channels enclosing the cavern and the inner circulation system. A circulating drying heat exchange medium for exchanging heat between the circulating medium and the surroundings around the first inner circulation system is introduced into the first inner circulation system and a circulating heat exchange drying medium for exchanging heat between the circulating medium and the surroundings around the second outer circulation system is also employed by maintaining heat exchange with the surroundings of said first inner circulation system keeping its walls, floor, and ceiling of the cavern at a predetermined temperature above a temperature of the stored materials when storing hot materials below the temperature of the hot materials to form a temperature barrier envelope about said cavern. Ice sublimation rate at the cavern in a cryogenic storage is reduced by operating one or both circulation systems below 0° C. when the cryogenic materials stored in said cavern is at a temperature below 0° C. and maintaining the temperature barrier about and below the cavern at a higher level than that of said cryogenic material. Sublimed water vapor from ice and water in the area of said first inner circulation system, and when needed in the second outer circulation system is absorbed and removed by heat exchange and drying medium in the inner (outer) circulation system. The installation may be operated to remove water out of the storage wall, applying the gas diffusion principal.

45 Claims, 17 Drawing Figures

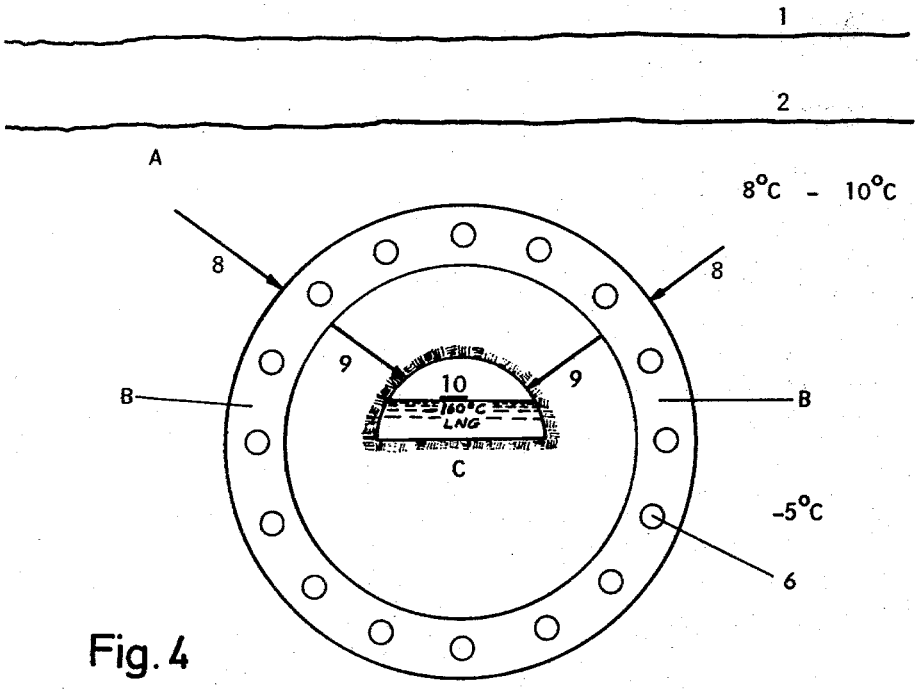
Fig. 4
Fig. 5
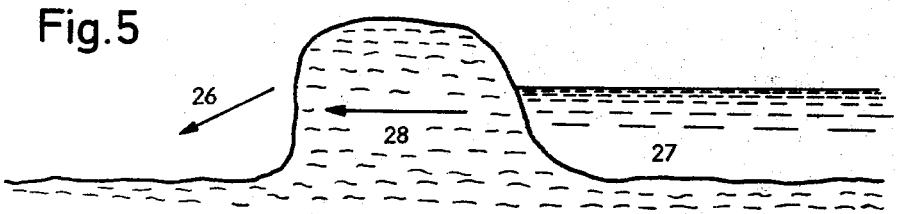

PROCESS FOR SAFE UNDERGROUND STORAGE OF MATERIALS AND APPARATUS FOR STORAGE OF SUCH MATERIALS

The present invention is a continuation-in-part of U.S. Pat. No. 4,121,429 entitled Underground Storage for Cold and Hot Products and Methods for Constructing Same.

Excessive cracking of the underground construction material, migration of water, and the development of leaks are the most significant problems encountered in cryogenic underground storage. The extremely low temperatures employed, influence in particular, the original distribution of water in the area and its environs. This leads to comprehensive water migration, which in turn gives rise to several further serious problems such as: operational difficulties; destruction or impairment of cavern insulation employed; penetration of liquid barriers in the cavern insulation, ground heaving, and so on. On account of the low heat conductivity of the materials used it may take years before the temperatures around the cavern reach their final values, and changes therefore proceed slowly and gradually, some of these changes not being noticible until several months of operation have elapsed. If, as described in my issued U.S. Pat. No. 4,121,429 hot materials are being stored instead of cryogenic products, several of the corresponding changes take place in the opposite direction. As explained in said U.S. Pat. No. 4,121,429, I prefer for illustrative purposes (column 2, line 39 of said paper) to select cryogenic storage as a typical example of the use of my invention though the same principles always are applied, since the same physical laws are in operation. To create a humid free space, for example, in the case of storing hot materials, the temperatures and/or the relative humidities of the two below mentioned surrounding circulation systems may have to be interchanged, causing the humidity to migrate away from the humid free storage space in question.

The prior art to date do not consider all of these problems to their full extent or at all. As a result, not a single cryogenic underground storage installation in rock is therefore operating successfully—if at all—today.

Though underground storage facilities can be constructed of concrete and located underground in sand, silt, etc., only rock storage will be discussed in the following. The basic principles, however, will in all cases remain the same. The following patent applications are referred to for priority:

The invention relates in particular to an improved method for the safe underground storage of cryogenic products and to the safe underground storage installation itself. More particularly the present invention also employes the diffusion principle with a view to prevent the migration of water vapor in rock, introduces in the case of cryogenic storage an outer frozen zone, enveloping the cryogenic storage and its surrounding temperature barrier, to reduce the diffusion rate of the water vapor itself in rock and in order to maintain the initial and natural degree of impermeability of the rock, and, finally, to solve the water drainage problem underground in the most economical manner by preventing liquid water from entering the storage area. The method also provides an increase in safety. The invention is thus simultaneously solving several problems which are of great concern in cryogenic underground storage. These and other cryogenic storage problems are related to the very nature of the construction material, to changes engendered during the construction procedure, and, above all, later generated through changes which develop by the introduction of the extremely low cryogenic temperatures at the beginning of storage. As already explained, changes in the opposite direction may take place if storage of hot materials are taking place.

In my U.S. Pat. No. 4,121,429, the avoidance of cracking of the cavern rock wall through temperature contraction was described, thereby solving one of the difficulties arising from introducing the mentioned temperature differences when storing cryogenic products. This was done by heating the rock wall in an underground installation to prevent the temperatures from falling outside—in cryogenic installations above all below—the approximate range −50° C. to 10° C., using a heat exchange medium to supply the necessary and relatively small required heat quantities. In particular, a gas is employed, which is pumped around in a circulating system in the form of a channel system, which system is located in the rock and around the storage cavern, near its surface. The temperature of the cryogenic condensed gases is far below 0° C. This circulating system as employed in U.S. Pat. No. 4,121,429 is hereinafter referred to in the present invention as an inner circulating system. By supplying heat to this system, which involves comparatively small heat quantities, a temperature barrier is created around the cryogenic cavern. This system was as indicated in U.S. Pat. No. 4,121,429 devised to solve further problems such as picking up and removing oncoming water vapors, sense and remove leaked-out products, and tightening of cracks in the rock wall. These solutions are also being availed of in the present invention, which constitutes a further improvement of previous art. For the sake of clarity, some of the previously treated problems will be dealt with here once more again.

Rock foundations are not tight from the beginning. All rock materials are porous, contain crevices, cracks, interstices, and intersecting cracks. Some of these interstices or cracks are filled with water, and by removing such tightening water, be it by drainage, evaporation, or sublimation, this will always result in a reduction of the tightness of the rock and an increase of its permeability. Once such tightening water has been removed out of the rock it is impossible to put it back again. One of the aims of this invention is therefore to try to retain this tightening liquid in its original place, or, if a removal process occurs, arrange for a corresponding compensation to replace lost substance. It should be obvious that any change of temperature in a rock leads to a transfer of water, whether the rock is heated or cooled in one particular place. By proper choice of temperatures the direction of a transfer of water may be chosen. As will be mentioned below, this holds true as long as the degree of saturation remains constant in the whole area.

According to the approach of this invention, only the liquid water within an outer circular frozen will, when constructing a cryogenic storage,—as described below—drain into a storage cavern area during construction if no additional tightening operations are undertaken. It should be noted that also in this design a freezing zone, as the one described hereinafter, must, in conformity with what was mentioned in my earlier suggestions in the field of cryogenic storage, be separated from the actual cavern by a device or a process that prevents water vapor from sublimed ice—the quantities of these water vapors, however, according to the present invention actually being reduced by lowering the temperature where the frozen outer zone is located—from destilling over to the cavern wall, which process, as is well known, would be fatal. For other reasons the freezing zone would have to be located at some distance from the cavern. As will be shown hereinafter, the required cooling capacity for the freezing of this outer zone may partly be acquired from the "cold" calories lost from the storage space to the cavern wall, a loss that cannot be avoided. In the following we shall discuss the background of such a cryogenic storage design more in detail. The aforementioned cryogenic storage is an implementation of principles which can be applied in storage of hot products, though some of the operating measures must be used in the reverse direction.

FIG. 1 illustrates what happens when no tightening measures have been undertaken to prevent enclosed water in rock from being drained into a cavern during the construction of an underground cavern. When excavating, enclosed water 4 from the rock above will drain into the space 10, and water from the water table 2 below the ground surface 1 will continue to pour into the construction site, leaving a depression 5 of the water table.

Large cracks in the rock may best be tightened by injection of cement. Other cracks may with advantage and to begin with be sealed by low pressure injection, e.g. with epoxy resins at about 3 kp per $cm^2$, followed by a later injection at up to 100 kp per $cm^2$. High injection pressures to start with, may, however, cause considerable damage, which is the reason why the rock quality first should be improved by glueing cracks at low pressures.

Assuming that injection with epoxy resins will not be sufficient, the freezing of an enveloping ringformed zone B, shaped like an horizontal cylinder and generated by e.g. freeze pipes 6 as FIG. 2 shows, will, when constructing a cryogenic storage, stop any remaining drainage into the cavern 10 at the same time as this provides—as will be explained below—the further important advantage of depressing the water vapor pressure at B, reducing the slope of the water vapor pressure drop between zone B and the storage 10 and at the same time diminishing the corresponding temperature gradient. The water at 3 then cannot any more penetrate from zone A through zone B into zone C. Water entrapped at 7 may leak into the excavated space 10, if a preinjection of epoxy resins or cement in existant cracks has not been sufficient. The temperature at B is below 0° C., but not so far below 0° C. that the rock cracks or unnecessary stresses are being created. As a rule, the natural temperature of the underground environment ist mostly, at least in Northern Europe, in the range of about 8° C. to 10° C. It should be obvious to any one that, if naturally existant water can be retained in the crevices, cracks, pores, and interstices around the cavern, this will make the storage surroundings tighter, less impervious, in particular to gases, and make it less likely that any leaked-out gases from the stored product may reach the outer environment.

Water cannot only migrate in rock in liquid form but also in the form of water vapor. Water vapor migrates, according to physical laws, to the area with the lowest water vapor pressure, i.e. to the coldest point, unless water vapor pressure is controlled by other means.

Specifically, according to known physical laws water vapor will "distill" from a warmer area or medium to a colder spot, which fact is known to those who have observed water depositing on a window pane in cold weather at the same time as water in an open vessel in the same room disappears. Another way of expressing this is to say that water vapor moves from areas with higher water vapor pressures to areas where the water vapor pressures are lower. This process is in the food manufacturing industry implemented in practice and then referred to as a "freeze drying process", but it is in principle nothing more than a distillation. If water is frozen to ice, the same "distilling process" from ice to ice is referred to as sublimation. Ice can thus through sublimation (evaporation) migrate as water vapor from a certain spot and deposit as ice in a different area where the temperature of the ice is still lower. This is exactly what happened in all underground cryogenic installations up to now, causing considerable damage. Moisture has seeped through the rock towards the storage cavern and has not only come in contact with the low temperature of the insulation of the storage chamber and adversely affected its valuable insulating properties, but the water vapor has also worked its way up through the insulation to an internal liquid barrier, whereby the lower temperature of the cavern freezes the water outside the barrier. The ice thus formed will ultimately break the internal liquid barrier, which cannot be tolerated. The ice crystals formed exert considerable pressure which in the past has resulted in crumbling and removal of the insulation applied inside the cavern. From this it should be clear that the described transfer of water vapor in the direction of the cavern must be prevented under all circumstances. In the present design this imperative requisite has been met.

During the aforementioned discussion above, it has been assumed that the water vapor was saturated, i.e. the maximum possible water vapor pressure at a certain temperature was developed. This is, however, by no means always certain and may be subject to change during the operation of the storage. If sufficient water is not present the full saturated water vapor pressure can naturally not develop. However, it still holds true that water vapor in all cases will migrate towards areas with lower water vapor pressures. The difference in water vapor pressure between two areas may be interpreted as a driving force and proportional to the rate with which the migration takes place. As will be seen hereinafter, saturated water vapor pressures may be artificially reduced through drying or diffusional operations by simply removing water vapor from the space in question. The prior art has disregarded the above mentioned circumstances that saturated water vapor pressures do not always prevail.

It goes without saying that by working below 0° C. the drainage problem is practically eliminated. The zone B thus functions vis-à-vis the storage 10 as a protective ice umbrella against oncoming water at the same time as it fulfills its tightening function and depresses the water vapor diffusion rate in the direction of the storage cavern.

In FIG. 3 water vapor pressures over ice and water have been plotted As can be seen, water vapor pressures decrease rapidly with temperature, and the pressure drop can be interpreted as approximately proportional to the rate with which the water vapor will move between the different points, assuming saturated conditions, which—as mentioned above—not always will be the case.

With reference to FIG. 4 and to what thus has been stated in the foregoing water tends to migrate as arrow 8 shows from zone A towards zone B, because the water vapor pressure—disregarding gravity—in zone B, which is frozen, is lower. Assuming the water vapor in A is saturated the drop in temperature of the migrating water vapor on its way to B implies that water, and, later in proximity of or within zone B, ice precipitates during the transfer. This explains the formation of huge ice rings around many in-ground cryogenic tanks, often leading to devastating ground heaving and the destruction of the foundations of steel and concrete tanks. If the supply of water is limited in the outer environs, these areas become pervious to gases, which is a known experience around so called earthern pits, where gas leaks have become an intolerable problem. A sufficient supply of water in the surroundings A is therefore mandatory. Other complicated water migration processes than the one described may also occur in the rock but the mentioned water vapor migration is the governing process.

The ice in zone B, on the other hand, tends—in conformity with what has been said—to migrate by sublimation—as the arrow 9 indicates—towards a still colder area with a still lower water vapor pressure, namely to zone C in FIG. 4, near and around the cavern 10. This last mentioned migration process must in a practical installation be prevented from affecting the areas around the cryogenic storage walls. The lower the temperature in zone B is, the less the rate of water vapor diffusion from B towards C will be. The low temperature at B makes zone B operate in conformity with an ohmic resistance, reducing the quantities of water vapor moving in direction 9 at the same time as zone B, as mentioned, works as a shield against liquid water flow towards the storage.

The idea of lowering the water vapor migration rate in an enveloping zone (B) with a view towards lessening the load on the equipment absorbing or removing water vapor 9 in an enclosed zone (C) was never described or applied by the prior art (See FIG. 4). Nor has it earlier, as shown in FIG. 4, been proposed to devise an arrangement whereby liquid water 8 from the outer water affluent zone (A) fills up potential voids in an enveloping frozen zone (B), as water vapor from sublimed ice (9) in this zone (B) is being removed by migration towards the enclosed zone C.

The existence of a cold spot thus behaves similarly to a pump, water being transferred from one area to another and being accumulated around the coldest spot. If a gas is not saturated with water, it is able to absorb water from the surroundings till it is saturated. A dry gas stream, 26, a wind, could be used to pump out water, migrating from a lake through a porous rock 28, which process, being slow, is illustrated in FIG. 5. If the air stream 26 is saturated, it cannot absorb more moisture, but if it is cold, it can by lowering the temperature and thus the corresponding water vapor pressure make water from the lake 27 migrate through the porous rock 28. Removing water with an extremely dry gas stream was one of the important functions fullfilled by the inner circulation system in my previous patent applications. FIG. 6 illustrates this, showing an indicated water vapor pressure curve 29 along the distance and abscissa x from the center line c of the storage cavern, bore hole 22 (24) (equipped with a water vapor meter 41) being one of a plurality of horizontal bore holes in the inner circulation system around a cryogenic cavern. Moisture will not pass further than an approximate line 30.

In FIG. 7 reference is made to the introduction of a temperature barrier around a bore hole 22 (24) in an inner circulation system, the plot depicting three temperature points ($T_1$, $T_2$, $T_3$) on three different distances x from the center line c, $\alpha_1$, $\alpha_2$ and $\alpha_3$ being three theoretical angles to illustrate three theoretical temperature gradients and their indicated influence on the rate of water vapor transfer. The change of temperature gradients influences not only the water vapor pressures in the area but also the rate of water vapor migration. $T_1$ is the temperature of the stored liquid (insulation not shown), $T_2$ (indicated by thermometer 42) the temperature of the temperature barrier and $T_3$ (indicated by thermometer 44) at bore hole 25 the temperature of the outer environment. In practice, an insulation will, of course, be used.

If the frozen zone B in FIG. 4 is being generated by circulating a gas stream through bore holes 6 the humidity of the stream must be controlled. Lowering the temperature in zone B may with reference to above lead to water vapor precipitating as ice in this zone, when water vapor from the outer zone A is migrating towards and into zone B, If ice is beginning to accumulate in or around zone B (water vapor pressure meter 43 and thermometer 44 in the outer circulation system 25) indicates the operating conditions, a sufficient drying capacity must therefore be given to the drying gas in channels 6. On the other hand, an unrequired and excessive drying-out of the outer environment is expensive, and can, as mentioned above, lead to ground heaving, when large masses of water are being moved. Through the freezing process in zone B additional strong forces are being liberated, and if water removed from the outer environment is not being replaced the danger of increased perviousness arises.

From the above it should be obvious that two circulation systems in parallel, an inner 24 and an outer 25 system, will permit complete control and optimal operating conditions, in particular as the two systems—among other things—may not only exchange heat but be regulated simultaneously to cooperate (See FIG. 9). While the inner circulation system requires a supply of heat to establish a temperature barrier at a satisfactory level, the outer system calls for heat removal to create the outer ice zone, the protecting ice umbrella or shield, to solve the drainage problem and reduce the flow of water vapor toward the cavern. This heat exchange, when not utilized elsewhere, is a clear advantage from a technical and economical point of view.

In FIGS. 8 and 9 water vapor pressures and temperatures along a distance x from the cavern center line c have been plotted respectively, reflecting two different operating situations and referring to five points, using approximative data, the temperature of the environment assumed to be in the range 8° C. to 10° C. at E. The continous line corresponds to the condition after freezing zone B in FIG. 4 but before any water removal out of the rock has taken place, apart from the migration of water, which unavoidably occurs when freezing zone B. Borehole 24 refers to the inner circulation system, which then in this situation is about to be put on stream. Dashed lines reflect the situation some time after start-up and drying up of the rock wall. The moisture represented by the area ABCDD'C'B'A will thus in time reach the cavern wall with its insulation, if no additional water vapor removal steps are being taken, but the rate at which water vapor will leave the zone around D' (25) depends on its temperature, and will be influenced by the high water vapor pressures indicated at B-C and the temperature around 24, the inner circulation system. When discussing factors involved, the mentioned extremely slow temperature changes, which may require years before reaching an equilibrium, may perhaps best be visualized by considering the rock to consist of a multitude of rows of small elements, more or less tightly closed, between which innumerable equilibria will be created. However, the extremely low water vapor pressures appearing in the direction of the cavern and around it will be the final governing factor. From experience, it is also well known that water vapor from the environs precipitates as ice at the cavern walls or at the walls of the in-ground tanks. In such cases—in particular at low temperatures, when noticible temperature contraction also occurs—pieces of rock also fall into the cavern, and the foundations of the in-ground tanks are destroyed. Of this reason a drying function was given to the inner circulation system in previous patent applications to prevent water vapor from reaching the cavern wall, causing damage to the insulation etc. FIG. 10 illustrates how humidity along the cavern wall and humidity, emanating from the environs or the area around the outer circulation system, will in stead be made to move toward the very dry area around the inner circulation system. Such a "moisture trap", which picks up moisture, prevents operational difficulties, damage to the insulation, and penetration of liquid barriers. The dry gas is produced with the aid of molecular sieves and other equipment.

Beside temperatures, other parameters such as pressure, humidity content, gas composition may be varied or set at a desired level in each circulating system, thereby offering further possibilities of controlling the operating situation and the introduction of further interesting processes to boot.

One such possibility is to avail oneself of the principle of diffusion, using a carrier gas. Even if the rock has been well tightened, the driving force of the water vapor, indicated by the steep drop of the corresponding water vapor pressure curve in FIG. 3, will make water vapor diffuse through the pores of the rock. If water vapors can diffuse through the material, so will gases. The driving force in both cases is not different in principle, namely a pressure drop. If such a gas, a carrier gas, present in the storage and in the inner circulation system, experiences a sufficient pressure drop, declining in the direction from the storage via the inner circulation system 24 to the outer circulation system 25, the carrier gas receives an average velocity in excess of that of the water vapor and will sweep out the slower travelling water molecules into the outer circulation system 25 and prevent them from entering the rock area thus swept out. The carrier gas can be sent back to storage 10 and/or the inner circulation system or both, such carrier gas being circulated. The carrier gas system would constitute a third closed gas recirculating system, which also would involve the use of water removal equipment. As a rule, gas diffusion takes place with a velocity of the order of less than one meter per hour. Diffusion rates are available in the literature, and diffusion rates are easily determined and calculated. FIG. 11 reflects the water vapor pressure situation in a rock storage wall after having dried out the rock cavern wall, allowing carrier gas to circulate between the inner 24 and outer 25 circulation systems. The velocity vectors should be self explanatory.

Another use of applying different pressures in various parts of the cavern installation concerns the important factor safety of operating such a storage as explained in my earlier U.S. Pat. No. 4,121,429. In contrast to prior art, I have in U.S. Pat. No. 4,121,429; suggested an external safety system, working at a lower pressure than that of the storage facility and thus attracting leaked-out gases from the original numerous systems of cracks and new ones created by possible thermal stress or may be by earth quakes, though, as a rule, earth quakes do not affect underground caverns, as the earth quake wave travels along the surface of the earth. The principle of said safety system is illustrated in FIG. 12, which shows the use of only one inner circulation system as an external safety system, P referring to existing pressure along the abscissa x, x=0 being located at the center line c of the storage, 31 signifying various flow directions of flowing leaked-out gases, and 32 general direction of migrating water vapor. The actual pressures in the circulation system are being measured by meter 45 and another meter in outer system 25 (not shown).

It is important to notice that as was suggested in U.S. Pat. No. 4,121,429 the principle of using a reduced pressure in the circulation systems in relation to the pressure in the storage is congruent with the idea of applying the principle of diffusion for water removal, implementing an increasing pressure drop from storage in the direction of the outer circulation system.

It will in this connection be proper to point out that a purging system is not operating according to the same principle, as it avails itself of an excess pressure, which does not attract leaked-out gases. Previous purging systems have ben located internally in the tanks. Safety of operating an installation will also require that leaked-out gases can be retrieved and sent back to storage, which processes were described in my earlier patent applications. Both circulation systems can be used for this purpose, each fulfilling this function if the other system is used for something else, e.g. tightening purposes.

In my previous patent applications it was described how an underground storage wall was tightened by introducing a tightening fluid under pressure in the circulation system, if required, after cooling down the area with a view to open up cracks. Particularly swelling compounds were recommended, which after contact with leaked-out product or water experienced a swelling process, thereby closing tightened cracks firmer. Both circulation systems may be subjected to such tightening procedures, and a single bore hole may be selected for such an operation after having been found to be connected with a leaking source. The method and its advantages are divulged in FIG. 13, where the sealing pressure applied, $P_s$ measured by meter 47, curve 34, is plotted along the abscissa x, arrow 33 showing the main direction of the flow of the tightening fluid. From the figure it should be obvious that cracks 35 in the direction of the storage tend to be closed, while the cracks in the direction of the environment 36 are being left open, which fact is of significance. It may finally be drawn attention to the importance of having a method at disposal, which in fact can be applied during operation and thus does not require a shut-down of the storing process for repair purposes, which latter must be a step that should be avoided under all circumstances.

It is equally important to note that according to the design philosophy of the present invention it is assumed that the purpose of the insulation is primarily to insulate and thus reduce heat transfer and then in second place to prevent the liquid content from reaching the rock surface. If a crack in the insulation should occur, this will only imply an infinitisimal additional heat loss. That the design philosophy thus put forward is imperative should be obvious to anybody who realizes that an installation of this kind, which may have to operate for decades without interruption, must not be dependent on the workmanship of one single man, on some incalculable stress in the ground, or a sheer accidental cause. A method for tightening leaks, discover leaks, and recover leaked-out products during operation is therefore an indispensible part of the specification of such a plant. The details associated with this are incorporated in this application by reference to my U.S. Pat. No. 4,121,429.

The reason why a so called "cold trap", located outside the cavern wall and operating at a lower temperature than that of the storage is not used, is, of course, dependant on the fact that such a cold trap would make the rock crack, even if it—to begin with—would attract moisture from all directions. It will neither function to cool the storage wall with heat exchangers, the temperature of which run slightly above those of the stored liquid, the heat exchangers being located in the wall of the storage. Such a design would, of course, crack the rock wall and create innumerable leaks—apart from attracting moisture from the environs, leading to damage to the insulation etc.

It should be remembered that changing temperatures in the rock is an extremely slow process, which at the same time implies changes of water vapor pressures, which in turn lead to the development of other changes in the rock, e.g. the process which sometimes may lead to ground heaving. This holds true whether cold or hot products are being stored. The problem of rock cracking and the distribution of stress in the rock should be kept in mind. Each temperature difference in relation to the original natural temperature of the environment create changes, stresses, and unbalances. With the use of strain gages, humidity measuring instruments, thermometers, pressure measuring instruments, etc. a balanced operation of the storage area can be attained with the aid of programed electronic control instruments. Having two circulation systems permits each of them can be used to control and set the desired temperature gradient between the two systems. Each of them may thus be used to dry up the surroundings of its circulation system with the aid of a dried circulating gas, while also each system may be used for tightening cracks in the rock formation and applying pressure. In addition, each circulation system may be used as a safety system, applying a recover slightly reduced pressure in relation to the leaking source, in order to detect leaks and leaked-out product—all in conformity with that set fourth in my U.S. Pat. No. 4,121,429.

The task of the outer circulation system is, though, to begin with, to bring down the temperature of its surroundings as fast as possible and form an ice umbrella, thereby solving the water drainage problem and the rock tightening problem before the construction of the cavern area starts. To start with, and under the construction period and also when otherwise permissible, air is therefore used as a cooling medium in this outer circulation system. This early cooling of the outer circulation system will cause water to migrate also from the future cavern area towards the outer cold system. After water has been removed out of the rock cavern wall and around the inner cooling system, e.g. with dry warm air, the actual storing of cryogenic fluid may begin after completion of the remaining construction work.

Steady state conditions for cryogenic storage will arise through: controlling the humidity content of the circulating media, by choosing a proper relationship between the pressures in the storage area, in the inner and outer circulation systems with a view towards applying product leak detection and product removal from the inner circulation system and, if required, the same detection and removal steps with regard to the outer circulation system, as well as applying water removal according to the law of diffusion; further by simultaneously adjusting the temperature barrier and the temperature level in the outer circulating system.

After sufficient time has elapsed beyond start-up, the following occurs:

1. The area around the inner circulation system is dry, and practically all water between this system and the storage area wall will have been removed. The temperature barrier is sufficient high to prevent cracking. By proper selection of the gas, the diffusion carrier gas, by a suitable choice of three pressures and two pressure differentials between the storage, the inner and outer circulation systems this will remove practically all water between the areas of the inner and outer circulation systems. The drying function of the gas in this inner circulation system then to a great extent acts as a safety measure (See FIG. 11).

2. The temperature level of the outer circulation system is maintained below 0° C., ensuring the existance of the water tightening ice umbrella, and is thus adjusted to serve as a cold trap for water emanating as well—this at least in the beginning—from the area between the two circulating systems as from the outside environment. A steady state in the area of this "cold trap", the water tightening umbrella, is created.

3. Sensitive analytical instruments continuously check if leaks occur, leaked-out products being removed out of the circulating streams and sent back to source.

4. The circulating systems exchange heat; circulating streams form a closed circuit; diffused gas is being returned to source after removal of humidity and contaminents.

IN THE DRAWINGS

FIG. 1 is a schematic sectional view illustrating water being emptied into the cavern, resulting in a dip of the water table level;

FIG. 2 showing the effect of FIG. 1 having a ring-formed freezing zone, drawn with horizontal freeze pipes for illustrative purposes;

FIG. 4 is a schematic sectional view illustrating the movement of sublimed ice with respect to the storage cavern and the supply of liquid water from the environs to the ice ring;

FIG. 5 is a schematic view illustrating the pumping action of a dry or cold gas stream;

Pipes for filling and removal of liquid or gas may be conventional and may not be shown in the drawings. The same goes for some other equipment and instrumentation required. Corresponding parts have been given the same numerals.

CONSTRUCTION OF THE STORAGE CAVERN

Figure 1:
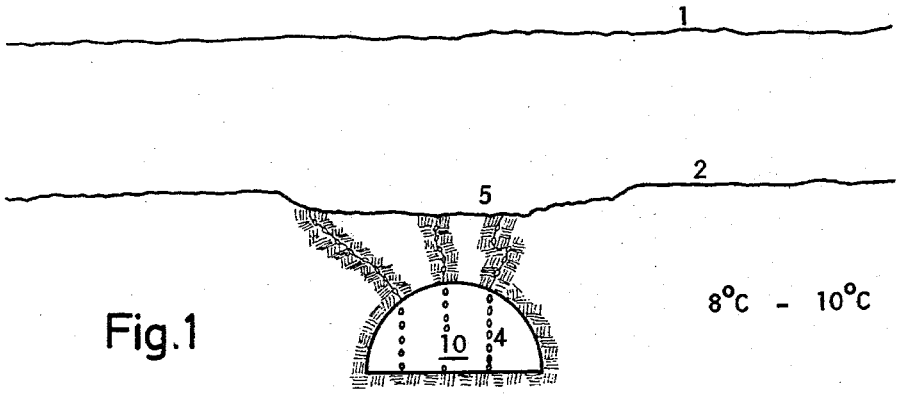
Figure 2:
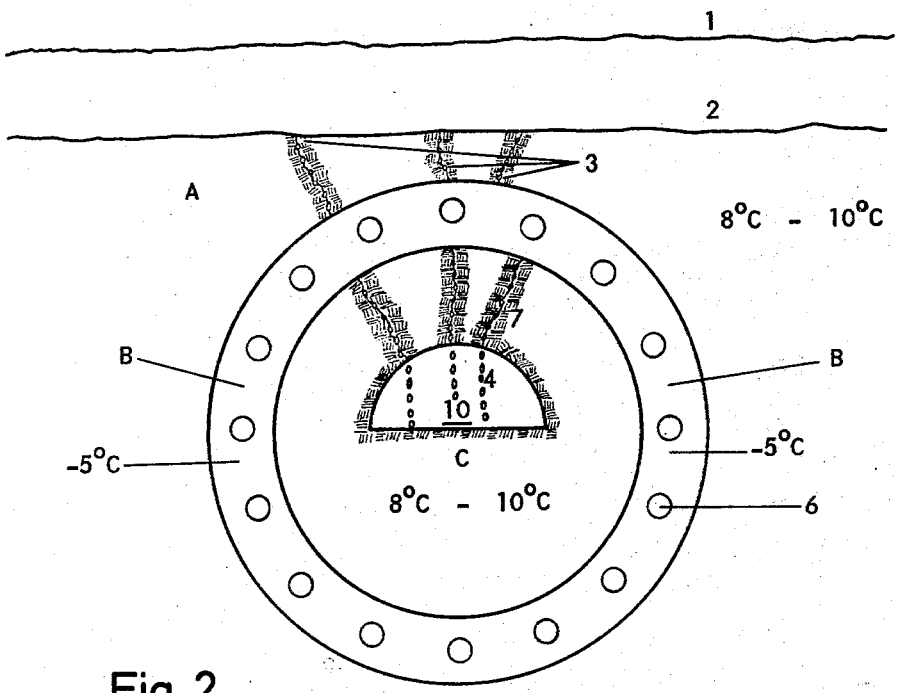
Figure 3:
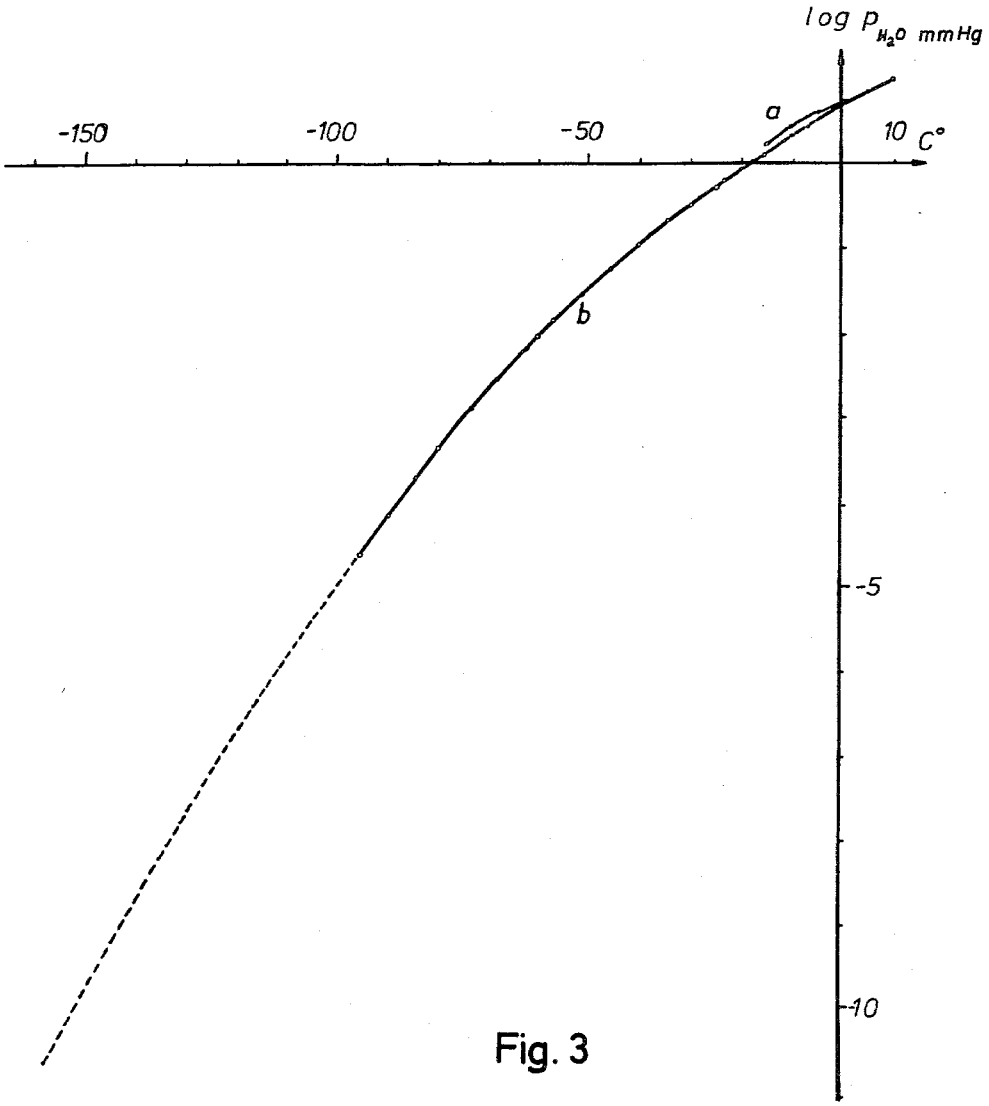
FIG. 3 is a graph illustrating water vapor pressures over water and ice respectively.
Figure 6:
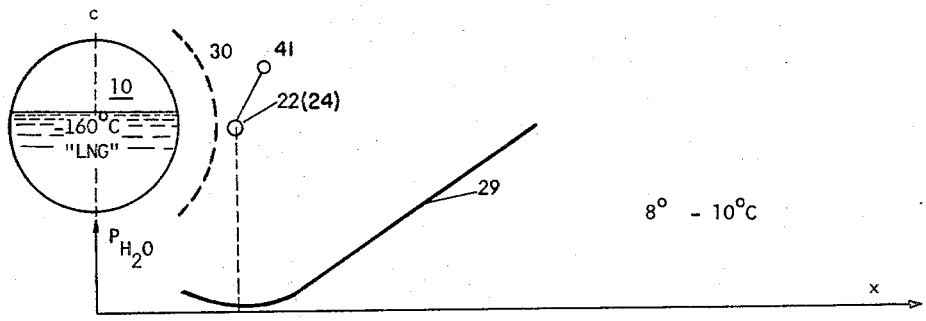
FIG. 6 is a pictural illustration showing the effect of the formation of a moisture trap about the cavern.
Figure 7:
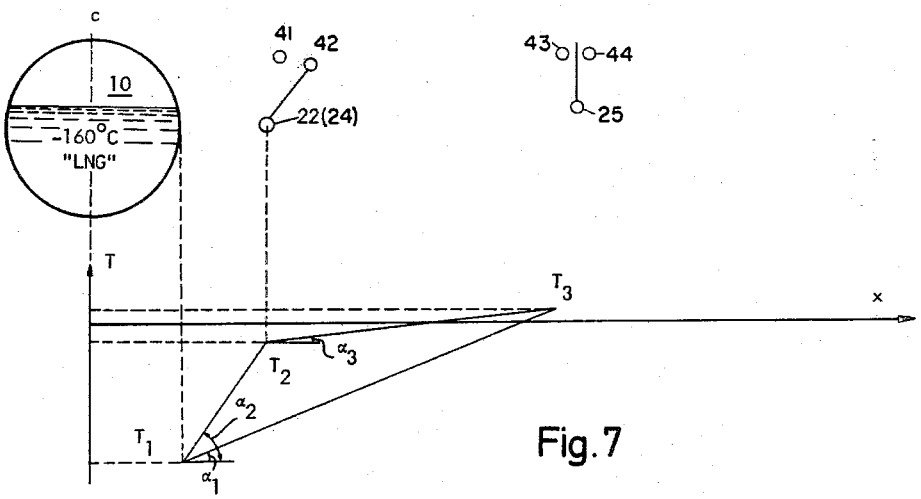
FIG. 7 is a pictural illustration of the use of a temperature barrier and its effect on the water vapor migration.
Figure 8:
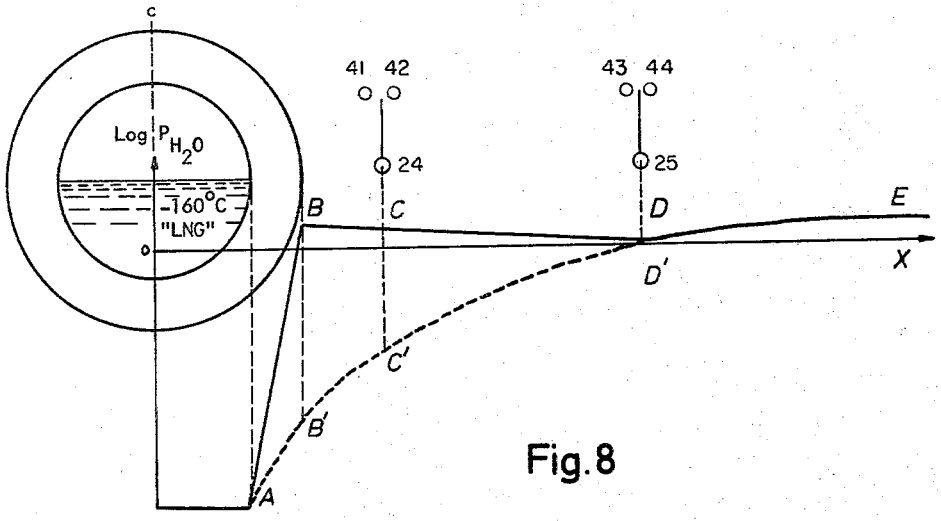
FIG. 8 is a diagramatic schematic illustration of the distribution of the water vapor pressures in the storage area after freezing of the outer zone, the ice umbrella, using no drying gas; continous line: before filling cryogenic liquid; dashed line: actual water vapor pressures some time after start-up of the cryogenic cavern.
Figure 9:
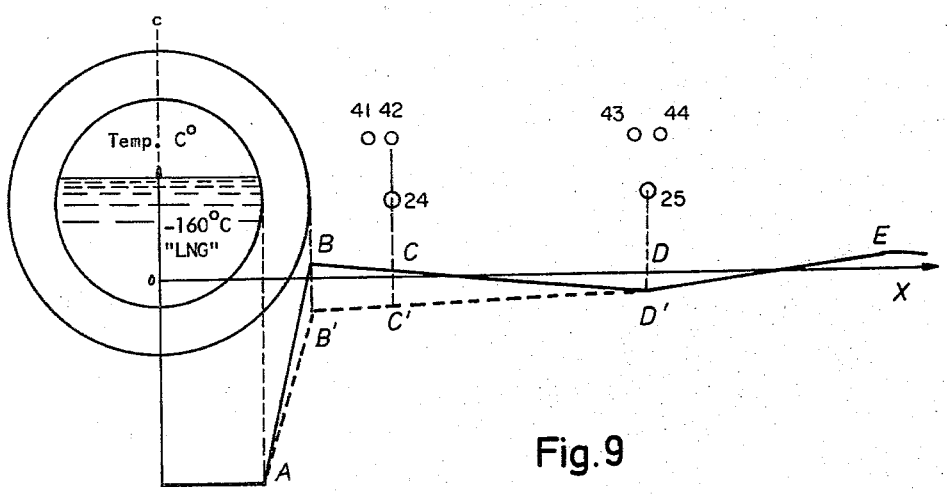
FIG. 9 is a diagramatic schematic illustration of the temperatures, corresponding to the data in FIG. 8.
Figure 10:
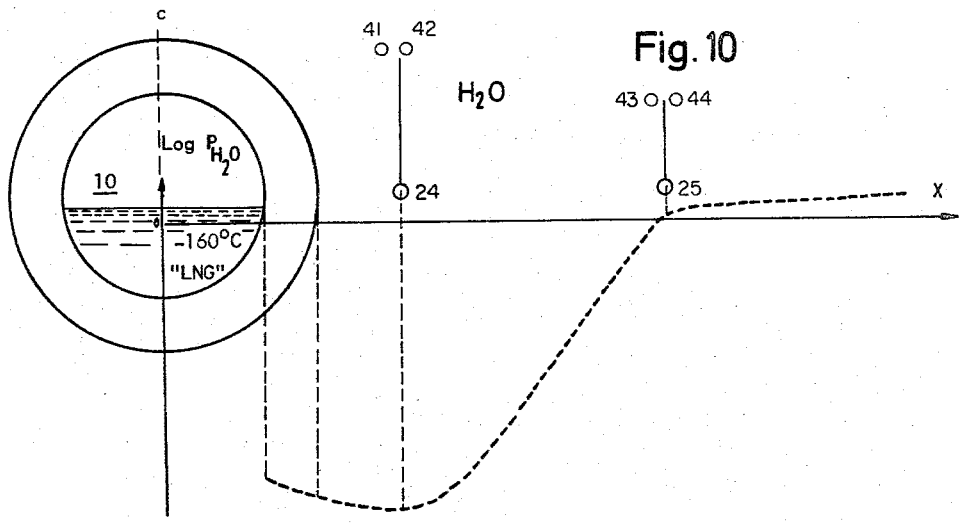
FIG. 10 is a diagramatic schematic illustration of the distribution of the water vapor pressure some time after start-up if a drying gas has been used in FIG. 8.
Figure 11:
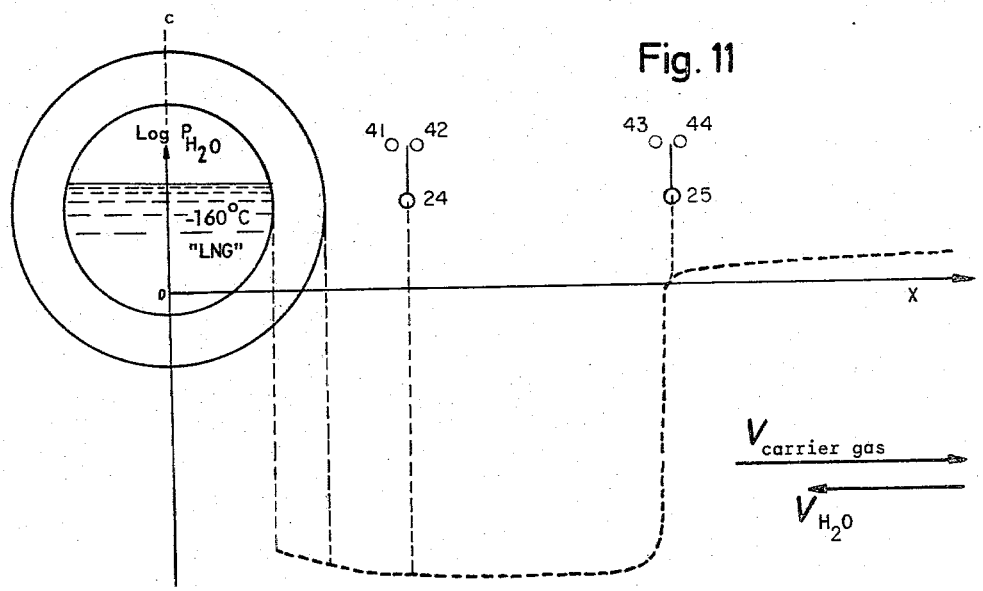
FIG. 11 is a diagramatic schematic illustration of the distribution of the water vapor pressures some time after start-up when applying the diffusion principle, introducing carrier gas in the inner circulation system 24 and removing the gas out of the outer circulation system 25.
Figure 12:
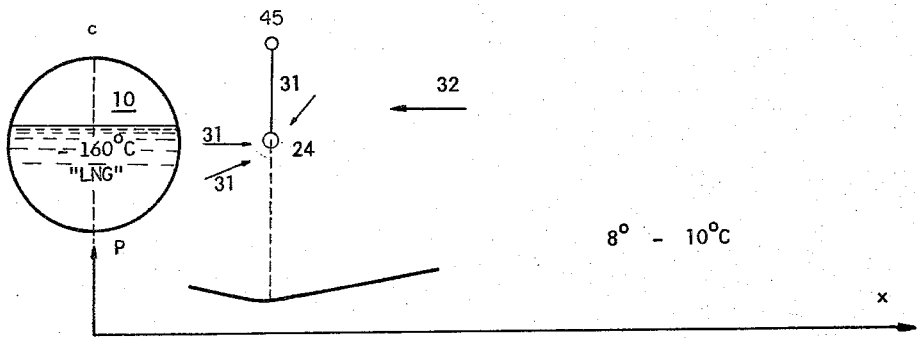
FIG. 12 is a pictural illustration showing the use of a slightly reduced pressure in the circulation system in relation to the pressure of the storage as part of a gaseous product leakage monitoring system.
Figure 13:
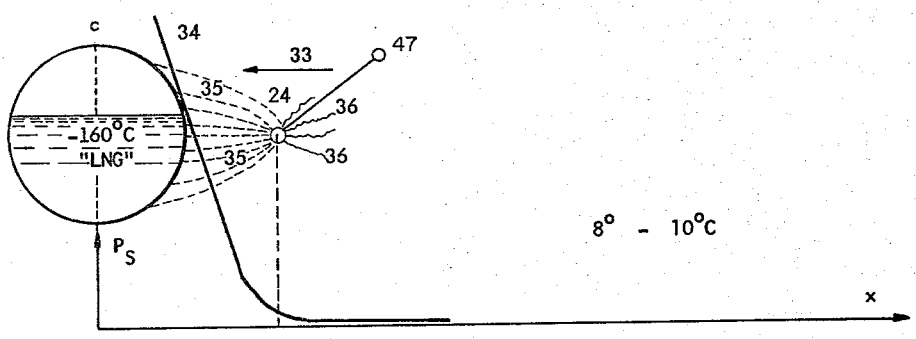
FIG. 13 is a pictural illustration showing the effects of pressure drop during cavern crack tightening operations.
Figure 14:
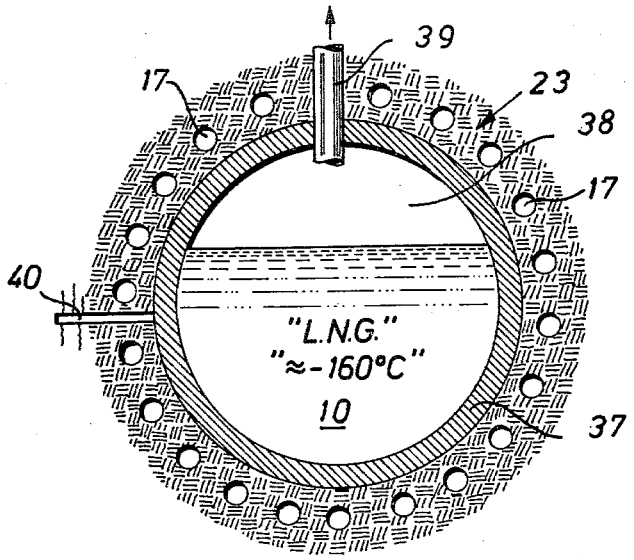
FIG. 14 is a schematic sectional view in elevation of a cylindric type of underground storage reservoir according to the invention with a plurality of horizontal bore holes for the inner circulating system.
Figure 15:
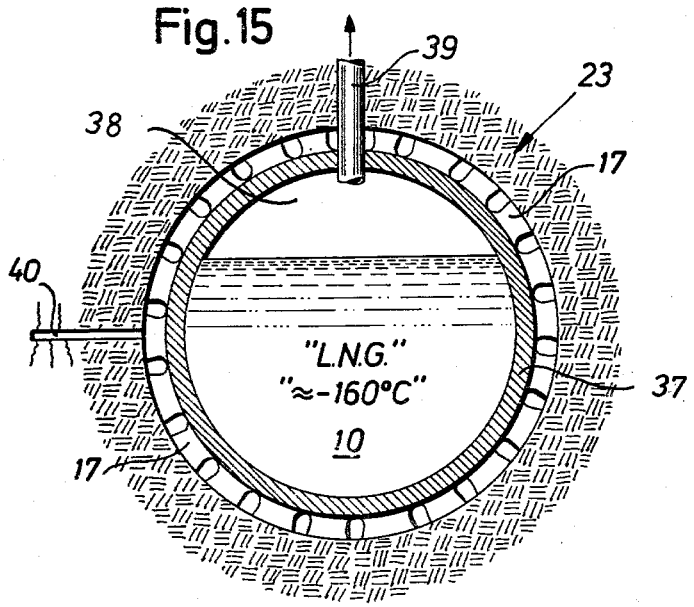
FIG. 15 illustrates a schematic sectional elevation of a horizontal type of underground storage reservoir according to a modification of the same invention with a plurality of circulation channels.

The bore holes 17 according to FIG. 14 may be drilled near and along the rock surface of the storage cavern 10 or cast in a concrete wall inside a rock cavern 10. In FIG. 15 the inner circulation channels 17 are for the inner system between the actual outer rock storage wall or cast concrete wall and an inner insulated wall, insulation as in FIG. 14 signified by 37, evaporation space by 38, gas vent by 39.

Figure 16:
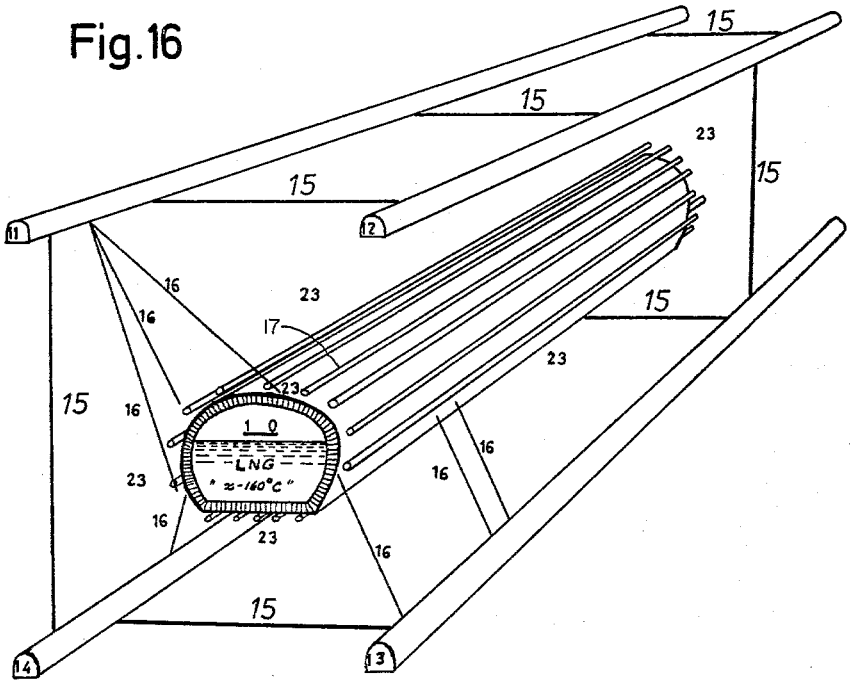
FIG. 16 is a view in perspective of the rock storage area with auxiliary tunnels, which together with the drilled bore holes between these tunnels constitutes the secondary outer circulation system.
Figure 17:
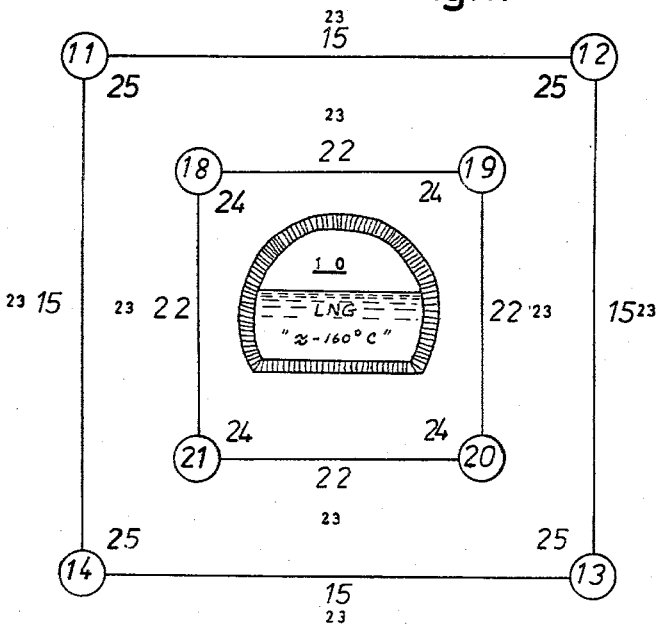
FIG. 17 is a schematic sectional elevation of a horizontal cavern, showing the two circulation systems; constructed on the basis of two separate tunnel systems.

FIGS. 16 and 17 show in principle how an underground storage 10 of the kind is to be built according to the present invention and modern low cost methods. During construction a downgrade access tunnel is formed, and, as a rule, four auxiliary tunnels 11–14 are excavated, using for the purpose designed automatic machines with equipment for the removal of produced pieces of rock. Between these four horizontal auxiliary tunnels 11–14, built for the preparation of the actual storage area, a regular net of bore holes 15 are drilled with the aid of special modern hydraulic automatic high speed drilling machines. The plurality of bore holes 15 between these tunnels 11–14 and the tunnels themselves enclosing the actual future cavern and the future inner circulation system, at the same time constituting the actual outer circulation system (corresponds to zone B in FIG. 4). By circulating a cool gas in the tunnel system 11–14 and bore holes 15, a common refrigeration unit for the two systems may be used. The water in the rock in the area 11–14, 15 will freeze, forming an ice umbrella or zone of ice; this freezing prevents, as already mentioned, the rock from being emptied of water during the continued next phase of construction. In this way, the rock is also kept impervious, and the inflow of water from the environs stopped. Large water flows must first in conventional manner be stopped with injection of cement.

In FIG. 16 horizontally drilled bore holes 17 for the inner circulation system are shown. Such bore holes are more expensive to drill than according to the method envisaged in FIG. 17, the reason being that the method illustrated in FIG. 16 will require niches to be made about every fourty meters, because present technique does not allow drilling longer holes.

To begin with, cool air is always used as a cooling medium to permit construction to continue without delay. The temperature of the outer circulation system should be brought down below 0° C. as soon as possible with a view to cause migration of water routed from the storage area toward the outer environment and create the ice umbrella at an early stage.

As soon as the inner circulation system is ready, heated dry air is circulated in this system as well as in the cavern so as to remove water around the inner circulation system and the rock wall.

The four auxiliary tunnels 11–14 (a different number of tunnels may be used) are excavated for preparing the area where the actual storage is to be constructed. The use of tunnels to establish the outer circulating system is thus a secondary matter. By drilling the holes 16 from these tunnels into the future storage area and injecting cement and epoxy resins or similar compounds at low pressures, i.e. about 3 kp per $cm^2$, the quality of the rock is greatly increased, fissures closed, and cracked surfaces glued together. After the storage area has been excavated, a more efficient high pressure injection may then be carried out from there (40 in FIGS. 14 and 15) to ensure complete tightness, using pressures up to 100 kp per $cm^2$. Tunnels 18–21 are then constructed, and bore holes 22 for the inner circulation system, perpendicular to the storage axis, are drilled. The storage area surface is then sealed with e.g. an epoxy resin layer, and insulation applied by spraying the sealed wall. It may finally be mentioned that both circulation systems could be based on a system of four tunnels.

I claim:

1. A method for the formation and operation of a safe storage area to hold cryogenic material, said storage area being in the form of an underground storage cavern in a solid formation, said stored material is maintained at a different temperature from the natural temperature of the environs surrounding the wall, floor, and the ceiling of said storage cavern, said process including the steps of: arranging on the outside of said storage cavern, with insulation, an inner first circulation system surrounding said cavern; providing said circulation system with a plurality of channels regularly distributed around the cavern and near its surface and when working in rock by rock bore holes to be drilled between a first inner system for surrounding tunnels; these tunnels being parallel to the axis of the storage space, to thereby define tunnels and channels enclosing and surrounding the cavern; arranging a second outer circulation system further away from said cavern, on the outside of and in working relation to the first inner circulation system by providing a plurality of regularly distributed channels, said channels being formed between a second outer system of surrounding tunnels, forming said tunnels in parallel to the axis of the storage space and together with said last mentioned channels to enclose the cavern and the inner circulation system; introducing into the first inner circulation system a circulating heat exchange medium for exchanging heat between the circulating medium and the surroundings, around the first inner circulation system; introducing into the second outer circulation system a circulating heat exchange medium for exchanging heat between the circulating medium and the surroundings around the second outer circulation system; heating the surroundings of said first inner circulation system and by heat exchange causing its walls, floor, and ceiling of the cavern to remain at a predetermined temperature above a temperature of stored materials forming a temperature barrier envelope about said cavern; reducing the ice sublimation rate at said cavern by operating one or both circulation systems below 0° C. when said cryogenic materials stored in said cavern is at a temperature below 0° C.; absorbing and removing sublimed water vapor from ice and water in the area of said first inner circulation system by said heat exchange and drying medium in the inner circulation system; cooling the environment of the outer circulation system through recirculation with a gas, preferably with cool air, introduced therein during an initial period, and during a later period, when required, with other cool gases; maintaining the temperature of these heat exchange media below 0° C. to form a frozen zone around the outer circulation system; freezing water in the rock in proximity to the area of said cavern and around the outer circulation system simultaneously affecting the slope and the level of the temperature gradients in a desired manner around the cavern and halting liquid water flow in the direction of the cavern from the environs, preserving natural imperviousness of the rock.

2. A method for the formation and operation of a storage area as claimed in claim 1, including the steps of: introducing a drying medium in to the first inner circulation system to remove any sublimed water vapor, existant water, or ice.

3. A method for the formation and operation of a storage area as claimed in claim 1, including the step of: introducing a drying medium in the second outer recirculation system to remove any oncoming water vapor, ice, or water.

4. A method for the formation and operation of a storage area as claimed in claim 1, including the step of: exerting excess pressure in the inner and outer circulation systems tighten the surroundings of said cavern by distribution of a tightening material introduced in the systems.

5. A method for the formation and operation of a storage area as claimed in claim 1, including the steps of: adjusting the operating pressures in the cavern in the inner and outer circulation systems to cause a diffusion carrier gas as a heat exchange medium contained in the storage and in hollow spaces forming the circulation systems, to advance by means of a pressure drop in a direction from the cavern toward the inner circulation system and toward the outer circulation system; thereby, causing said diffusion carrier gas to flow at a rate sufficient to overcome the velocity of water vapor molecules travelling in the opposite direction to said carrier gas and removing water located in areas between the storage and the outer circulation system; and returning diffused carrier gas from the outer circulation system to the inner circulation system or storage or both, after removal of leaked-out products and water from the gas to be returned.

6. A method for the formation and operation of a storage area as claimed in claim 1, including the steps of: introducing a circulating medium in the form of a liquid.

7. A method as claimed in claim 1, including the steps of: introducing a circulating medium in the form of a gas taken from the group comprising: nitrogen, carbon dioxide, hydrocarbons, hydrogen or a mixture thereof.

8. A method as claimed in claim 1, including the steps of: introducing a circulating medium to remove water from the surroundings of the circulation system.

9. A method as claimed in claim 1, including the steps of: distributing a substance throughout the circulating system and its surroundings by said circulating medium.

10. A method as claimed in claim 1, including the steps of: monitoring said circulation systems for leaks of fluid out of the cavern into the respective circulation streams.

11. A method as claimed in claim 1, including the steps of: recovering stored cryogenic fluid which has leaked into the circulating system through said circulating medium, by recovering said fluid from the circulating stream through absorbtion.

12. The method as claimed in claim 1, including the steps of: providing heat exchange between the respective media in the respective inner and outer circulation systems.

13. A method as claimed in claim 1, including the steps of: chilling the surroundings of the respective circulating systems below normal operating temperature for opening up cracks in the rock formation forming said cavern and injecting sealing materials into the walls, ceiling and floor of the cavern and the surrounding surfaces of the inner and outer circulating systems respectively.

14. A method as claimed in claim 1, including the steps of: introducing sealing materials in the cavern walls and in the surroundings of the circulating systems, which materials swell upon contact with the cryogenic fluid being stored.

15. A method as claimed in claim 1, including the steps of: introducing sealing materials in the cavern and its surroundings, which materials swell upon contact with water.

16. A method as claimed in claim 1, including the steps of: employing said cavern as an evaporation chamber for cryogenic fluid being stored.

17. A method as claimed in claim 1, including the steps of: employing stored cryogenic fluid as a heat exchange medium for the evaporation of stored fluid.

18. A method as claimed in claim 1, including the steps of: applying a pressure differential for removing water, ice, and water vapor from said cavern and its surroundings by a carrier fluid.

19. A method as claimed in claim 1, including the steps of: excavating auxiliary tunnels in parallelism in several directions around said caverns in the form of an outer circulating system; forming a plurality of equally spaced drilled bore holes between said tunnels to enclose the caver and said inner circulating system; cooling said surroundings of said cavern below zero degrees to form a protective and tightening zone toward an oncoming flow of water; and removing water, ice and water vapor from its surroundings by using the drying medium of said outer circulating system.

20. A method as claimed in claim 1, including the steps of: excavating auxiliary tunnels in parallelism in several directions around said cavern form an inner circulation system; forming a plurality of equally spaced drilled bore holes between said tunnels to enclose the cavern: supplying heat to the circulating gas in said inner circulation system to prevent the temperature of its surroundings from falling below a predetermined desired value.

21. A method as claimed in claim 1, including the steps of: constructing the underground storage installation in concrete and locating it in a rock formation or a formation consisting of loose materials like sand, silt, clay, etc.

22. A method as claimed in claim 1, including the steps of: recovering stored cryogenic material which has leaked into the circulating system through said circulating medium, by recovering said material from the circulating stream through adsorbtion.

23. A method as claimed in claim 1, including the steps of: recovering stored cryogenic material which has leaked into the circulating system through said circulating medium, by recovering said material from the circulating stream through condensation.

24. A method as claimed in claim 1, wherein: said cavern is uninsulated.

25. A method as claimed in claim 1, including the steps of: drilling both circulation systems from the same set of tunnels.

26. An underground storage system for the storage of cryogenic materials, said materials being stored in cavern means formed in a solid earth formation wherein: two heat exchange circulating systems are disposed surrounding said cavern means; said systems being defined by a first inner system surrounded by a second outer one, the latter enveloping the first mentioned; each of said systems being formed with a plurality of equally distributed, parallely arranged hollow spaces; said hollow spaces of said inner system being formed in said solid formation bordering the storage cavern means; said spaces are formed preferably on the basis of a system of tunnels surrounding the cavern, the axis of said tunnels being parallel to the axis of the cavern; said hollow spaces of the second outer system being a system of hollow spaces and auxiliary tunnels, the axis of the tunnels being parallel to that of the cavern, tunnels and hollow spaces enclosing the cavern means and the inner circulation system; said inner circulation system employing a medium therein for respectively introducing and removing substances and water from said circulating system by injection, drainage and refining means associated therewith; and means to create a pressure drop in a direction from the cavern interior toward the outer circulation system, to allow carrier fluid advancing toward the outer circulation system to remove existing water and water vapor in the area located between the cavern and the outer recirculation system and means for returning diffused refined carrier fluid from the outer recirculation system back to the inner circulating system or to storage; said outer circulation system having a circulating medium for introducing and removing substances and water from the circulating system by injection, drainage and refining means associated therewith, said circulating system by cooling its environment to create a frozen zone around same: leakage monitoring means for discovering leaked cryogenic product which may have leaked into the circulating systems; control means and monitoring means for operation of said cavern means.

27. A storage system as claimed in claim 26, wherein: said circulating medium employed in said circulating system being a gas taken from the group comprising: nitrogen, carbon dioxide, hydrogen, or hydrocarbons, or a mixture of such gases.

28. A storage system as claimed in claim 26, wherein: said circulating medium employed in said circulating system is a liquid.

29. A method for the formation and operation of a safe storage area to hold hot materials, said storage area being in the form of an underground storage cavern in a solid earth formation, said stored materials being maintained at a different temperature from the natural temperature of the environs surrounding the walls, floor, and the ceiling of said storage cavern, said process including the steps of: arranging on the outside of said storage cavern, without insulation, an inner first circulation system with a plurality of hollow spaces regularly distributed around the cavern and near its surface by providing hollow spaces to be formed between a first inner system of surrounding tunnels; these tunnels being parallel to the axis of the storage space, to thereby define tunnels and hollow spaces enclosing and surrounding the cavern; arranging a second outer circulation system further away from said cavern and thus on the outside of and in working relation to the first inner circulation system by providing a plurality of regularly distributed hollow spaces, said hollow spaces being formed between a second outer system of surrounding tunnels, forming said tunnels in parallel to the axis of the storage space and together with said last mentioned hollow spaces to enclose the cavern and the inner circulation system; introducing into the first inner circulation system a circulating heat exchange medium for exchanging heat between the circulating medium and the surroundings around the first inner circulation system; introducing into the second outer circulation system a circulating heat exchange medium for exchanging heat between the circulating medium and the surroundings around the second outer circulation system; maintaining the walls, floor, and ceiling of the cavern at a predetermined temperature below a temperature of the stored materials by means of said inner circulation system and forming a temperature barrier envelope about said cavern; maintaining said temperature barrier about and below the cavern at a lower level than that of said stored materials; absorbing and removing oncoming water vapor and water in the area of said first inner circulation system by said heat exchange and drying medium in the inner circulation system; heating the environment of the outer circulation system through recirculation with a heat exchange media; and adjusting the temperature of these heat exchange media to affect the slope and the level of the temperature gradients in a desired manner around the cavern.

30. A method for the formation and operation of a storage area as claimed in claim 29 including the steps of: insulating the storage space walls.

31. A method as claimed in claim 29 including the steps of: forming hollow spaces in the second outer circulation system from the same inner tunnel system of which the hollow spaces of the inner circulation system have been formed.

32. A method for the formation and operation of a storage area as claimed in claim 29, including the steps of: cooling the environs of the second outer circulation system.

33. A method for the formation and operation of a storage area as claimed in claim 29, including the steps of: introducing a drying medium into the circulation system for removing water out of the inner circulation system.

34. A method for the formation and operation of a storage area as claimed in claim 29, including the steps of: introducing a drying medium into the outer circulation system to remove water out of the circulation system.

35. A method for the formation and operation of a storage area as claimed in claim 29, including the steps of: exerting excess pressure in one or more of said systems for tightening the surrounding of said cavern by distribution of a tightening material introduced in the systems.

36. A method for the formation and operation of a storage area as claimed in claim 29, including the steps of: introducing a circulating medium in the form of a liquid.

37. A method for the formation and operation of a storage area as claimed in claim 29, including the steps of: introducing a circulating medium in the form of a gas.

38. A method for the formation and operation of a storage area as claimed in claim 29, including the steps of: monitoring said circulation systems for leaks from materials stored.

39. A method for the formation and operation of a storage area as claimed in claim 29, including the steps of: recovering leaked out products, which have leaked into one or more of the circulating systems.

40. A method as claimed in claim 29, including the steps of: providing heat exchange between the respective media in the respective inner and outer circulation systems.

41. A method as claimed in claim 29, including the steps of: introducing sealing materials in the circulating systems, said materials having the propensity to swell.

42. A method as claimed in claim 29, including the steps of: employing only one of the circulation systems.

43. A method for the formation and operation of a storage area as claimed in claim 29, including the steps of: adjusting the operating pressures in the cavern, in the inner and outer circulation systems to cause a diffusion carrier gas as a heat exchange medium contained in the storage and in hollow spaces forming the circulation systems, to advance by means of a pressure drop in a direction towards the cavern from the outer circulation system thereby causing said diffusion carrier gas to flow at a rate sufficient to overcome the velocity of water vapor molecules travelling in the opposite direction to said carrier gas and removing water and other leaked-out products located in areas between the storage and outer circulation system; and returning diffused carrier gas from the storage to the inner circulation system or outer circulation system or both, after removal of leaked-out products and water from the gas to be returned.

44. A method of formation and operation of a storage area as claimed in claim 29, including the steps of: reversing the flow of the carrier gas and adjusting the required necessary operational steps in accordance herewith.

45. A method as claimed in claim 1 including the steps of: introducing a circulating medium in the form of a gas.

* * * * *

UNITED STATES PATENT AND TRADEMARK OFFICE

CERTIFICATE OF CORRECTION

PATENT NO. : 4,224,800

DATED : September 30, 1980

INVENTOR(S) : Grennard, Alf H.

It is certified that error appears in the above-identified patent and that said Letters Patent are hereby corrected as shown below:

Abstract:

Column 2, Line 5, after "surface" insert --, preferably formed between tunnels--;

Line 6, change "formed of the" to --and--;

Line 23, after "employed" insert --.--; change "by" to --By--;

Line 26, after "stored" insert --cryogenic--.

Column 1, Lines 50 and 51, delete "The following patent applications are referred to for priority:

Column 9, Line 53, delete "and" insert --,--;

UNITED STATES PATENT AND TRADEMARK OFFICE

CERTIFICATE OF CORRECTION

PATENT NO. : 4,224,800

DATED : September 30, 1980

INVENTOR(S) : Grennard, Alf H.

It is certified that error appears in the above-identified patent and that said Letters Patent are hereby corrected as shown below:

Column 9, Line 55, delete "recover";

Column 13, Line 59, after "systems" insert --to--;

Column 15, Line 2, after "caver" insert --n--.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*